US007535435B2

(12) United States Patent
Koyama

(10) Patent No.: US 7,535,435 B2
(45) Date of Patent: May 19, 2009

(54) PROJECTOR

(75) Inventor: Fumio Koyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 499 days.

(21) Appl. No.: 10/898,577

(22) Filed: Jul. 26, 2004

(65) Prior Publication Data

US 2005/0052346 A1 Mar. 10, 2005

(30) Foreign Application Priority Data

Sep. 2, 2003 (JP) ..... 2003-309529

(51) Int. Cl.
*G09G 3/00* (2006.01)
*G09G 3/36* (2006.01)
*G09G 3/34* (2006.01)

(52) U.S. Cl. ..... 345/32; 345/89; 345/90; 345/109

(58) Field of Classification Search ..... 345/32, 345/90, 108, 109, 89
See application file for complete search history.

(56) References Cited

U.S. PATENT DOCUMENTS 5,548,423 A 8/1996 Natsunaga
5,978,142 A * 11/1999 Blackham et al. ..... 359/618
6,856,304 B1 * 2/2005 Hirakata et al. ..... 345/32
6,943,756 B1 * 9/2005 Choi ..... 345/32
6,967,641 B1 * 11/2005 Macellin-Dibon ..... 345/109
7,136,035 B2 11/2006 Yoshida
7,145,520 B2 * 12/2006 Ramanujan ..... 345/32
2002/0101396 A1 * 8/2002 Huston et al. ..... 345/87
2006/0125753 A1 * 6/2006 Richards ..... 345/92

FOREIGN PATENT DOCUMENTS

CN 1431555 A 7/2003
JP 2001-100689 4/2001
JP A 2002-506228 2/2002
JP A 2002-538512 11/2002
WO WO 02/42826 A2 * 5/2002

* cited by examiner

*Primary Examiner*—Richard Hjerpe
*Assistant Examiner*—Randal Willis
(74) *Attorney, Agent, or Firm*—Oliff & Berridge, PLC

(57) ABSTRACT

The invention provides a projector a lighting optical system, a micro-lens array, a shutter array, a liquid crystal light valve, a projection optical system, and a modulation control portion. The modulation control portion can control the shutter array and the liquid crystal light valve in response to levels of gray-scale of colors specified by input image signals. When the gray-scale value is 1% or less, time-interval control is effected in such a manner that 1% of light is allowed to pass through by the shutter array, while a fine gray-scale expression is achieved by the liquid crystal light valve. Also, when the gray-scale value is 0%, light is shut out completely by the shutter. When configured in this manner, it is possible to improve the reproducibility at darker levels of gray-scale and the contrast characteristics. Accordingly, the display characteristics of an image from a liquid crystal projector can be improved.

14 Claims, 10 Drawing Sheets

PROJECTOR

BACKGROUND OF THE INVENTION

1. Field of Invention

The invention relates to techniques for improving a display characteristic of an image from a liquid crystal projector.

2. Description of Related Art

There are various types of projector, including a triple-tube projector, a DLP® projector, a liquid crystal projector, and the like., depending on the light modulation methods. Recently, there has been proposed a method by which light is modulated by a shutter array having a matrix of microscopic shutter elements. See, for example, JP-T-2002-506228 (the term "JP-T" as used herein means a published Japanese translation of a PCT patent application), JP-T-2002-538512, and International Publication No. WO 02/42826. Of all these types, the liquid crystal projector is particularly in demand due to its relatively low manufacturing costs.

SUMMARY OF THE INVENTION

The related liquid crystal projector, however, has a problem that the reproducibility at darker levels of gray-scale is poor because it is difficult for liquid crystals to completely shut out light emitted from a light source. Also, liquid crystals, being a so-called hold-type display device, have a problem that a frame displayed earlier remains as an after image to human eyes when frames are switched while moving pictures are played back, which appears as blur in an image.

An object of the invention is to improve a contrast characteristic and the moving-picture playback ability of a liquid crystal projector. The projector of the invention can include a light source, a liquid crystal light valve, a light quantity adjusting portion provided with elements in a one-to-one correspondence with respective pixels in the liquid crystal light valve, the elements adjusting the quantity of projection light by switching between two states for projecting light and for not projecting light at predetermined times, a modulation control portion to modulate light emitted from the light source by controlling the liquid crystal light valve and the light quantity adjusting portion in accordance with an image signal representing the image, and a projection portion to project the modulated light.

The light quantity adjusting portion can be, for example, the aforementioned shutter array, or a DMD (Digital Micromirror Device), ferroelectric liquid crystals, etc. These devices are characterized in that their contrast properties generally excel those of the liquid crystal light valve. However, because the light quantity adjusting portion adjusts a quantity of projection light according to a time schedule, there is a limit in the degree of resolution of the gray-scale. On the other hand, the liquid crystal light valve is inferior in contrast properties because it is difficult for it to shut out light completely, however, because it is able to adjust the quantity of transmitted light in an analog manner, it has an excellent gray-scale resolution. According to the invention, light is modulated by using both the liquid crystal light valve and the light quantity adjusting portion as described above. It is thus possible to improve the display characteristic of the projector by exploiting their respective advantages.

In the projector described above, the modulation control portion may cause the light quantity adjusting portion to reduce the quantity of projection light to zero in a case where a color specified by the image signal is at a darkest level of gray-scale. When configured in this manner, light can be shut out by the light quantity adjusting portion. It is thus possible to improve the reproducibility of black and colors at low brightness, which are difficult to express with the use of the liquid crystal light valve alone. In particular, when the light quantity adjusting portion is formed with a shutter array, the effect is high because light can be shut out almost completely.

In the projector described above, the modulation control portion may cause the light quantity adjusting portion to increase the quantity of projection light to a maximum quantity when the color specified by the image signal is at a brighter level of gray-scale than a predetermined reference level, and modulate light by the liquid crystal light valve to achieve the brighter level of gray-scale to be expressed.

The liquid crystal light valve has an excellent gray-scale resolution for bright colors, as opposed to for darker levels of gray-scale in the vicinity of black. Hence, when configured in this manner, in a case where a light specified by the image signal is at a brighter level of gray-scale than the predetermined reference level, a display exploiting the advantage of the liquid crystal light valve can be achieved.

In the projector described above, the modulation control portion may cause the light quantity adjusting portion to switch the quantity of projection light to be projected to a pre-set quantity of projection, in accordance with the level of gray-scale of a color specified by the image signal. The manner in which the switching takes place may be as follows, when a color specified by the image signal is at a relatively dark level of gray-scale, the modulation control portion may cause the light quantity adjusting portion to switch the quantity of projection light to a predetermined quantity, and modulate light by adjusting the liquid crystal light valve for the darker level of gray-scale to be expressed.

When configured in this manner, it can be possible to express basic dark levels of gray-scale by the light quantity adjusting portion and to express fine levels of gray-scale through modulation with the use of the liquid crystal light valve. Hence, even when a color to be displayed is at a dark level of gray-scale, it is still possible to achieve an expression with an excellent resolution.

In the projector described above, to the control timings of the respective pixels in said liquid crystal light valve, said modulation control portion brings in sync the control timings of the respective elements in said light quantity adjusting portion that correspond to the respective pixels. Generally, the timing at which the respective pixels in the liquid crystal light valve are controlled is not executed at one time across the entire liquid crystal surface, but executed sequentially upon units, each having a predetermined number of pixels. Hence, by bringing the timings at which the respective elements in the light quantity adjusting portion are controlled in sync with the control timings of the liquid crystal light valve, it is possible to reproduce colors at higher accuracy.

In the projector described above, the liquid crystal light valve may be provided with a liquid crystal panel, and a first polarizing plate made the light incoming surface and a second polarizing plate made the light outgoing surface so as to sandwich the liquid crystal panel, and the light quantity adjusting portion may be provided in at least one location selected from somewhere between the light source and the first polarizing plate, between the first polarizing plate and the liquid crystal panel, and between the liquid crystal panel and the second polarizing plate. When configured in this manner, by providing the light quantity adjusting portion between the light source and the first polarizing plate, it can be possible to suppress heat generation and deterioration in both the first polarizing plate and the second polarizing plate. Also, by providing the light quantity adjusting portion between the first polarizing plate and the liquid crystal panel, or between the liquid crystal panel and the second polarizing plate, it is possible to suppress heat generation and deterioration in the second polarizing plate.

In the projector described above where the liquid crystal light valve may be provided with a liquid crystal panel, and a first polarizing plate made the light incoming surface and a second polarizing plate made the light outgoing surface so as to sandwich the liquid crystal panel, the light quantity adjusting portion may be provided between the light source and the first polarizing plate, and a micro-lens array to condense light to the respective elements in the light quantity adjusting portion may be further provided between the light source and the light quantity adjusting portion. When configured in this manner, more light can be focused by removing the grid present on the periphery of the respective elements that together form the light quantity adjusting portion. It is thus possible to efficiently utilize light emitted from the light source.

In the projector described above, the modulation control portion may inhibit the light quantity adjusting portion from projecting light for a predetermined period within the period during which one frame of an image is displayed. When configured in this manner, an image in a period during which no light is projected is interpolated by the human brain, and it is therefore possible to display moving pictures with reduced perception of an after image. The period during which no light is projected can be about 75% of a one-frame display period, which is nearly equal to the display characteristic of a CRT. The one-frame display period referred to herein generally means. 1/60 sec. This control may be performed regardless of whether an image to be played back is a moving picture or a still image, or it may be performed only when moving pictures are played back. Alternatively, the user may switch the settings of this control as he desires.

In the configuration as described above, the period during which projection of light is inhibited may be the period from the start of display of the one frame to a predetermined elapsed time.

The liquid crystal light valve is a hold-type device, and the gray-scale is unstable near the start of display until the twist of the liquid crystals is aligned. Hence, by shutting out light with the use of the light quantity adjusting portion according to the configuration described above during the above period, it is possible to display moving pictures in a more stable manner.

In the invention, the various modes described above can be combined or omitted partially as needed for applications. In addition, the invention can be configured as a control method of the projector.

BRIEF DESCRIPTION OF THE DRAWINGS

This invention will be described with reference to the accompanying drawings, wherein like numerals reference like elements, and wherein.

DETAILED DESCRIPTION OF PREFERRED EMBODIMENTS

An exemplary embodiment of the invention will now be described.

Figure 1:
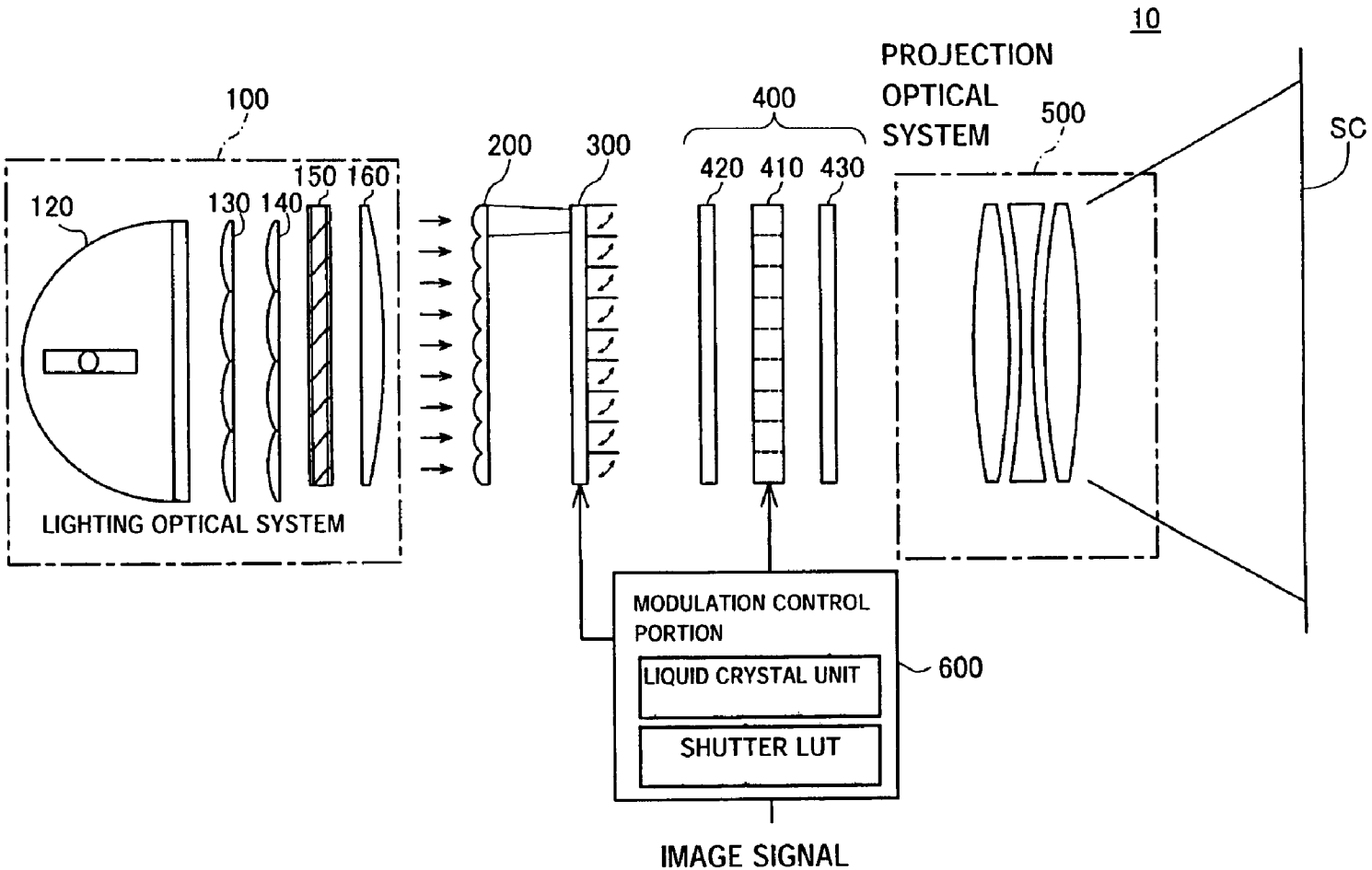
FIG. 1 is an explanatory view showing the schematic configuration of a projector by way of example.

FIG. 1 is an explanatory view showing the schematic configuration of a projector by way of example. A projector 10 can include a lighting optical system 100, a micro-lens array 200, a shutter array 300, a liquid crystal light valve 400, a projection optical system 500, and a modulation control portion 600.

The lighting optical system 100 can include a light source device 120, two lens arrays 130 and 140, a polarization converting element 150, and a superimposed lens 160. The lighting optical system 100 converts light emitted from the light source device 120 to linear beams of polarized light of one kind in a single polarization direction with the use of the functions of these optical systems, and emits the polarized light.

The micro-lens array 200 is a set of microscopic lenses. Respective lenses are provided in a one-to-one correspondence with respective shutter elements that together form the shutter array 300. The respective lenses focus light emitted from the lighting optical system 100 in apertures into the respective shutter elements of the shutter array 300. When configured in this manner, it is possible to inhibit irradiation of light to the grid portions in the shutter array 300, and hence to efficiently utilize light emitted from the light source.

The shutter array 300 can be a set of microscopic shutter elements. Respective shutter elements are provided in a one-to-one correspondence with respective pixels in the liquid crystal light valve 400. In this example, by the use of the shutter array 300, the contrast properties of the projector 10 are improved, and the sense of presence of an after image during the playback of moving pictures is suppressed. The shutter array 300 will be described in detail below.

The liquid crystal light valve 400 can include a liquid crystal panel 410, and a first polarizing plate 420 made the light incoming surface and a second polarizing plate 430 made the light outgoing surface, in a manner so as to sandwich the liquid crystal panel 410. The polarization axis of the first polarizing plate 420 is set in the same direction as the polarization direction of linear beams of polarized light passing through the micro-lens array 200 and the shutter array 300 to the first polarizing plate 420. Hence, most of light incident on the first polarizing plate 420 passes through the first polarizing plate intact. Polarized light that comes out from the first polarizing plate is modulated in the liquid crystal panel 400 according to the instruction from the modulation control portion 600. Of the light modulated in the liquid crystal panel, only the light components having a polarization direction along the polarization axis of the second polarizing plate 430 come out from the second polarizing plate 430.

The projection optical system 500 can include a projection lens, a zoom lens, etc., and scales up modulated light emitted from the second polarizing plate 430 in the liquid crystal light valve 400 to be projected on a screen SC.

The modulation control portion 600 receives image signals, such as a component signal, a composite signal, and an RGB signal, from a not-shown image output device, and modulates light emitted from the lighting optical system 100 by controlling the shutter array 300 and the liquid crystal light valve 400 in response to colors specified by the image signals. This control is achieved by referring to a liquid crystal look up table (liquid crystal LUT) and a shutter look up table (shutter LUT). The image output device can be a device, such as a DVD player, a video tape recorder, and a personal computer. The modulation control portion 600 can be formed from software with the use of a micro-computer equipped with a CPU, a ROM, and a RAM, or alternatively, it can be formed from hardware with the use of an LSI.

Figure 2:
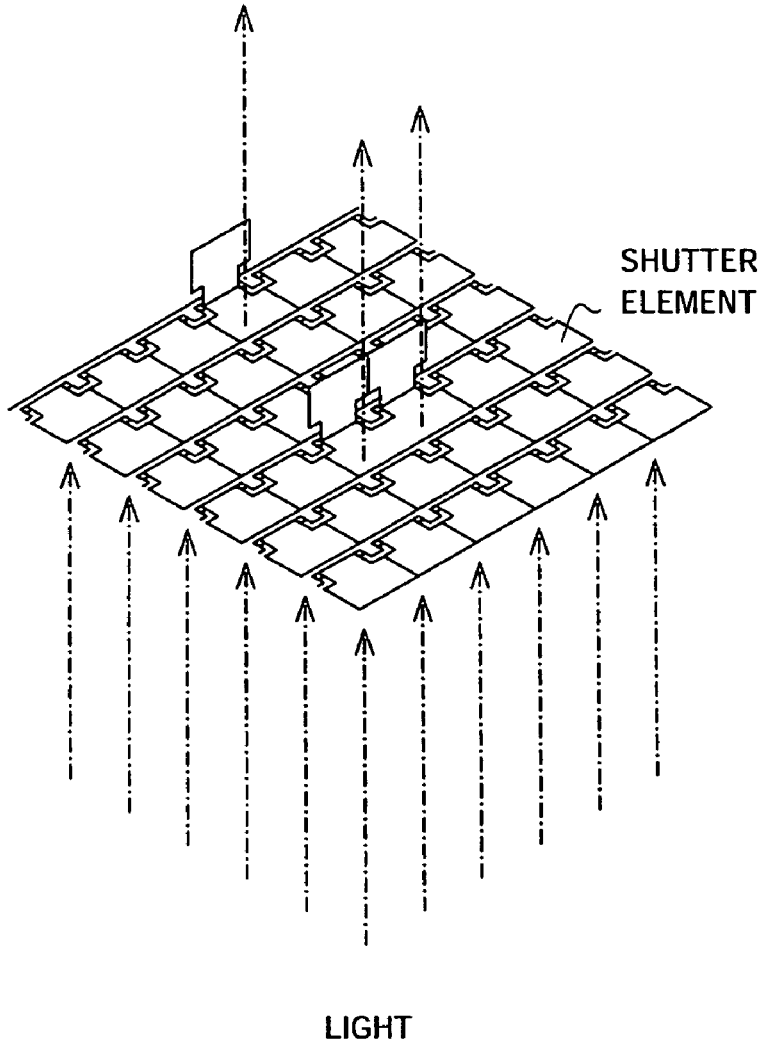
FIG. 2 is an explanatory view showing the schematic configuration of a shutter array.

FIG. 2 is an explanatory view showing the schematic configuration of the shutter array 300. As is shown in the drawing, the shutter array 300 is a set of microscopic shutter elements. The size of the respective shutter elements corresponds to the size of the respective pixels in the liquid crystal light valve 400. Each shutter element is allowed to open and close about the hinge provided to one side of the shutter element and used as the axis. Each shutter element, when closed, is able to shut out transmission of light almost completely, and the reproducibility of black can be thereby improved. The modulation control portion 600 adjusts the quantity of transmitted light by controlling this open/close operation according to a predetermined time schedule for switching between two conditions, one for projecting light and the other for not projecting light.

Figure 3:
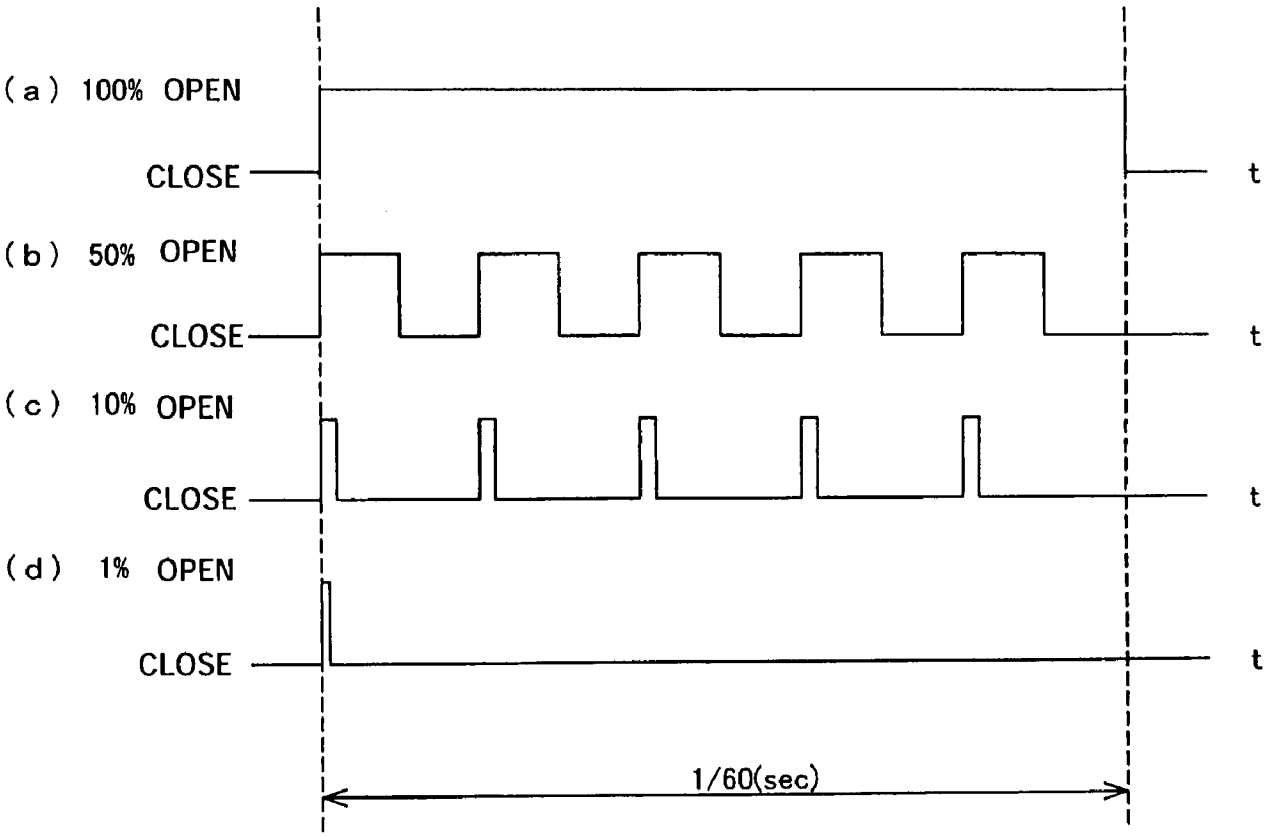
FIG. 3 is an explanatory view showing a time-divisional control method of the shutter array.

FIG. 3 is an explanatory chart showing a timing control method of the shutter array 300. FIG. 3(*a*) is the timing chart for the case where the maximum quantity of light is transmitted during a one-frame display period (1/60 sec.). In this case, a maximum quantity of light can be transmitted throughout one frame period by keeping the shutter elements open. FIG. 3(*b*) is a timing chart when 50% of a quantity of light is transmitted. In this case, as is shown in the drawing, the open state and the close state are switched alternately so that the total period that the shutter is open reaches 50% of that shown in FIG. 3(*a*). When configured in this manner, 50% of the light is transmitted. FIG. 3(*c*) and FIG. 3(*d*) show timing charts when 10% and 1% of the light, respectively, are transmitted by the same principle as FIG. 3(*b*). According to the time-divisional control, a quantity of light to be projected is adjusted by opening and closing the shutter elements at high speeds as described above.

Figure 4:
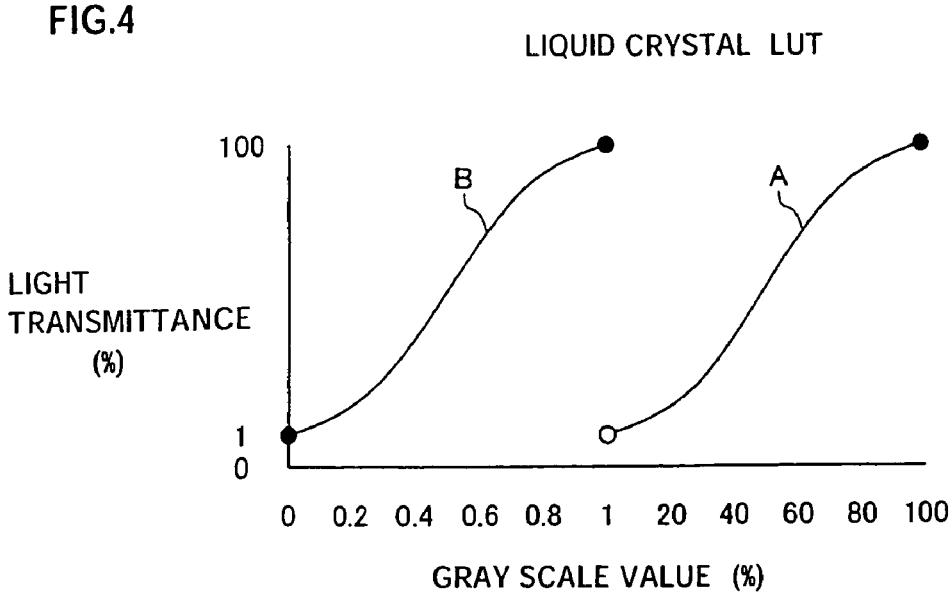
FIG. 4 is the graph defined by a liquid crystal LUT.

FIG. 4 is a graph defined in the liquid crystal LUT. The abscissa is used for the gray-scale values of colors specified by the image signal, expressed as a percentage. 0% is the darkest level of gray-scale and 100% is the brightest level of gray-scale. As is shown in the drawing, the abscissa is on different scales, for gray-scale values of 0 to 1% and for gray-scale values of 1 to 100%. On the other hand, the ordinate is used for light transmittance of the liquid crystal light valve 400 determined according to the gray-scale values. The modulation control portion 600 controls the liquid crystal light valve 400 in response to the gray-scale values of input image signals in such a manner that the light transmittance achieves the pre-set value. As is shown in the drawing, two discrete curves with similar shapes are defined in the liquid crystal LUT. Hence, in a case where the gray-scale value specified by an image signal is greater than 1% and equal to 100% or less, curve A is adopted, and in a case where the gray-scale value is 0 to 1%, both inclusive, curve B is adopted. For both the curves A and B, the minimum value of the light transmittance is 1%. This is because light cannot be completely shut due to the nature of the liquid crystal light valve 400.

Figure 5:
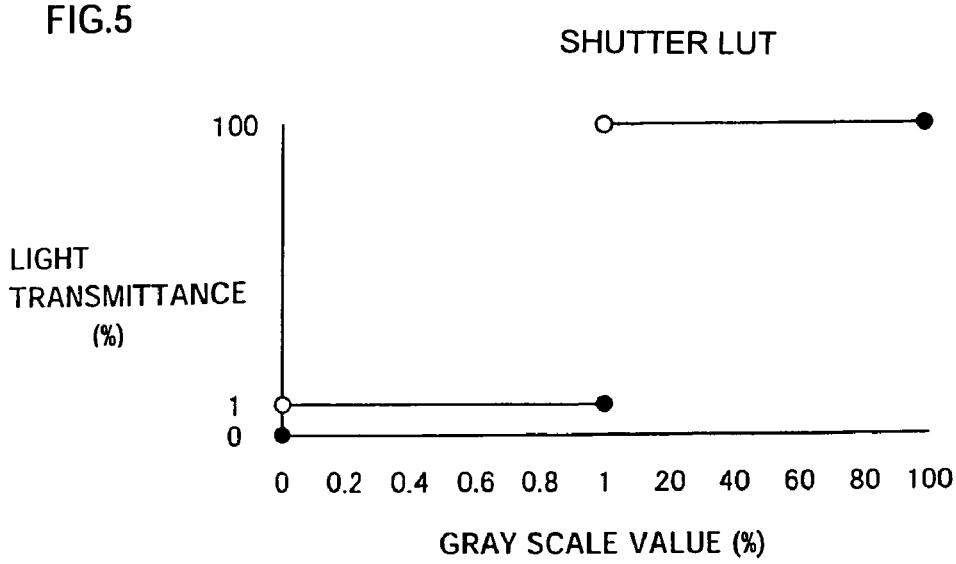
FIG. 5 is the graph defined by a shutter LUT.

FIG. 5 is a graph defined in the shutter LUT. As with FIG. 4, the abscissa is used for the gray-scale values of colors specified by the image signals, expressed as a percentage, and the gray-scale values are on different scales from 0 to 1% and from 1 to 100%. The ordinate expresses light transmittance (opening degree of the shutter) of the shutter array 300 set according to the gray-scale values. As is shown in the drawing, in the shutter LUT, in a case where the gray-scale value of a color specified by an image signal is greater than 1% and equal to 100% or less, the transmittance is fixed to 100%, and in a case where the gray-scale value is from 0 to 1%, both inclusive, the transmittance is fixed to 1%.

According to the liquid crystal LUT and the shutter LUT described above, in a case where the gray-scale value is greater than 1% and equal to 100% or less, the opening degree of the shutter array 300 is fixed to 100%, and light is thereby modulated by the liquid crystal light valve 400 alone. In a case where the gray-scale value is greater than 0% and equal to 1% or less, a quantity of transmitted light is limited to 1% by the shutter array 300. Subtle levels of gray-scale from 0.01% to 1% are thereby expressed by the liquid crystal light valve 400. In addition, when the gray-scale value is 0%, light transmittance is shut by the shutter array 300.

Figure 6:
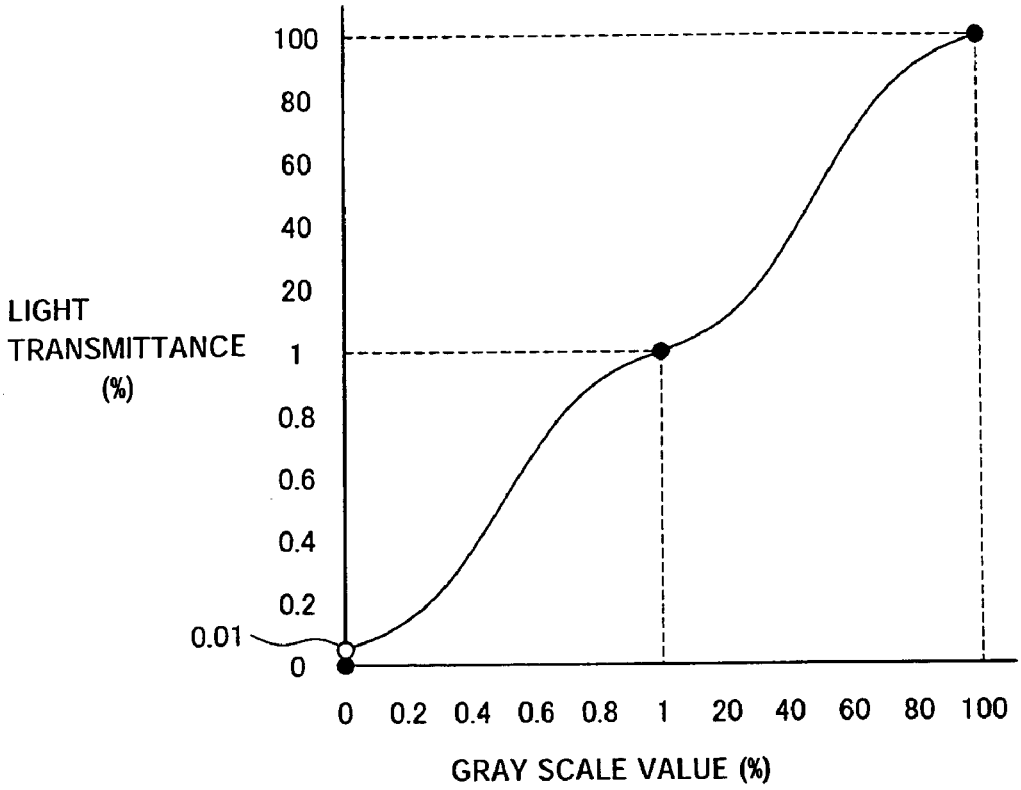
FIG. 6 is a graph made by virtually synthesizing graphs of FIG. 4 and FIG. 5.

FIG. 6 is a graph made by virtually synthesizing the graphs of FIG. 4 and FIG. 5. In this graph, both the ordinate and the abscissa are on different scales, for 0 to 1% and for 1 to 100%. According to this example, by using both the liquid crystal light valve 400 and the shutter array 300, it is possible to achieve a more detailed gray-scale expression at relatively dark levels of gray-scale as is shown in the drawing. That is to say, by using the shutter array 300 together with the liquid crystal light valve, the poor reproducibility of the liquid crystal light valve at darker levels of gray-scale can be markedly improved. Also, when the gray-scale value is 0%, because light is completely shut by the shutter array 300, the contrast characteristic can be improved significantly.

It goes without saying that light can be modulated by the shutter array 300 alone. However, because the shutter array 300 expresses the gray-scale through time-scheduling control, there is a limit in the degree of gray-scale resolution. On the contrary, by additionally using the liquid crystal light valve 400 capable of analog expression of the gray-scale as in this example, it is possible to achieve a more detailed gray-scale expression.

Figure 7:
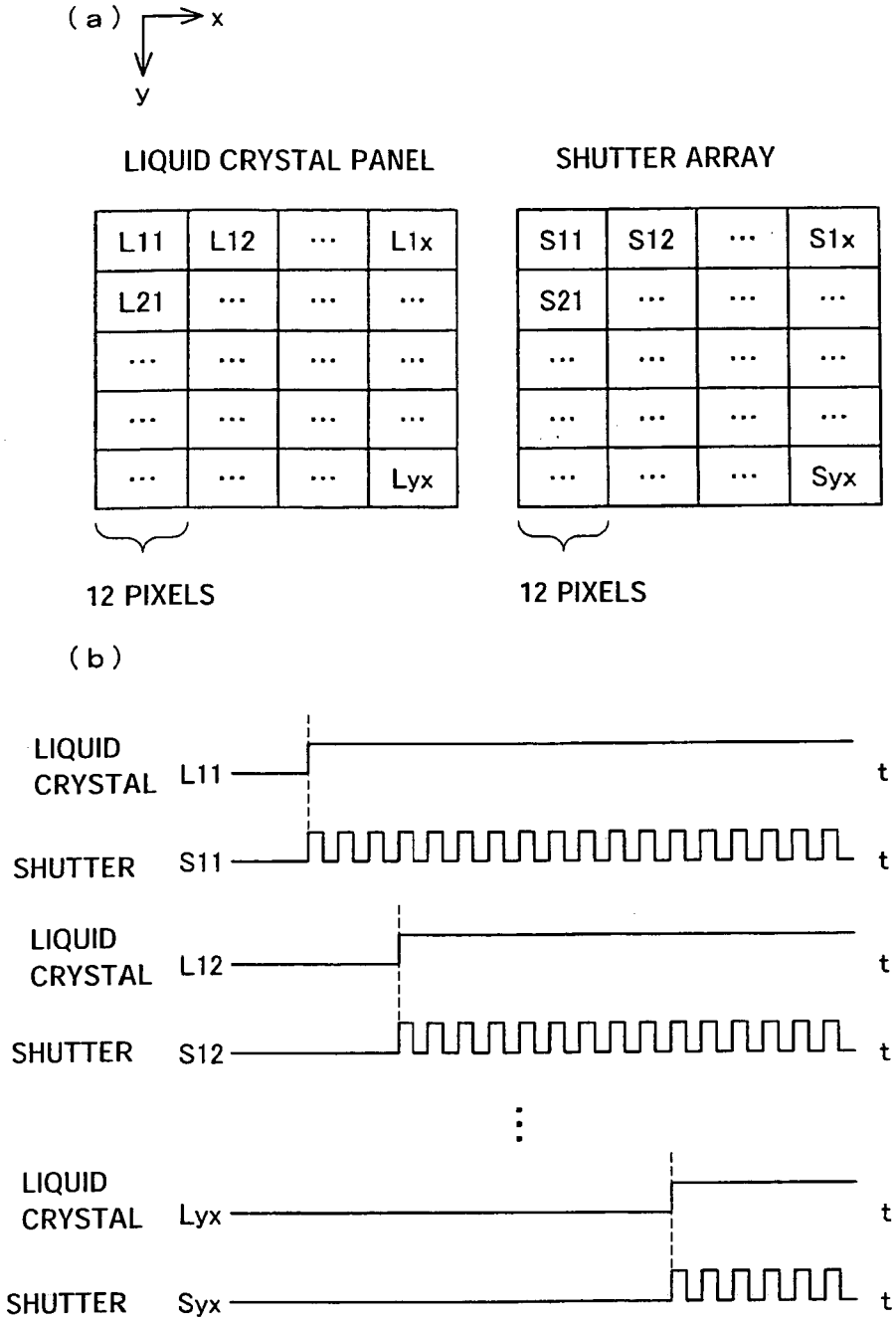
FIG. 7 is an explanatory view showing control timings of a liquid crystal light valve and the shutter array.

FIG. 7 is an explanatory view showing the control timings of the liquid crystal light valve 400 and the shutter array 300. The liquid crystal light valve 400 is normally driven 12 pixels at a time in the x direction. When the driving of one line ends, the control shifts to the following line. In other words, according to symbols shown in FIG. 7(*a*), the pixels are driven in order of L11, L12, . . . , L1*x*, L21, . . . , and Lyx. Here, in this example, the control timing of the shutter array 300 is brought into sync with the control timing of the liquid crystal light valve 400. That is to say, the shutter array 300 is also controlled 12 pixels at a time in order of S11, S12, . . . , S1*x*, S21, . . . , and Syx.

FIG. 7(*b*) is a timing chart in a case where the gray-scale value of the entire screen is changed from 0% to a predetermined gray-scale value at a given time. As has been described, because the liquid crystal light valve 400 and the shutter array 300 are controlled in sync with each other, as is shown in the drawing, signals are generated concurrently for the L11 and the S11, and subsequently signals are generated concurrently for the L12 and S12. Finally, signals are generated concurrently for the Lyx and Syx. By bringing the control timing of the liquid crystal light valve 400 into sync with the control timing of the shutter array 300 in this manner, it is possible to achieve modulation with good accuracy.

Figure 8:
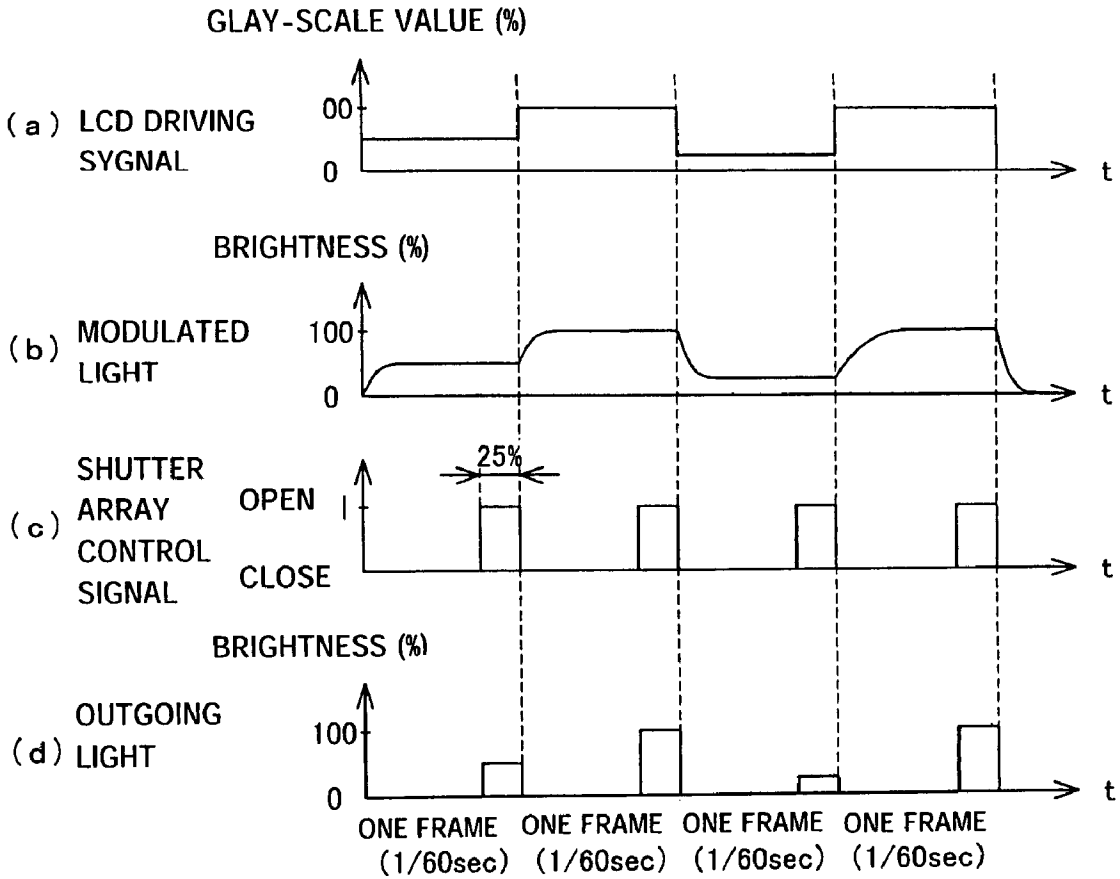
FIG. 8 is an explanatory view showing a control method of the shutter array in improving the playback ability of moving pictures.

FIG. 8 is an explanatory view showing the control method of the shutter array 300 in improving the playback ability of moving pictures. FIG. 8(*a*) is a timing chart of a control signal that drives the liquid crystal light valve 400. In a case shown herein, the gray-scale value is 50% in the first frame, 100% in the second frame, 25% in the third frame, and 100% in the fourth frame.

FIG. 8(*b*) is a timing chart showing brightness of modulated light modulated by the liquid crystal light valve 400 according to the control signal shown in FIG. 8(*a*). The liquid crystal light valve 400 has a slight time lag from the input of the control signal until the degree of twist of liquid crystals is stabilized. Hence, as is shown in the drawing, there is a period where the brightness is unstable in the initial stage of the frame.

In this example, as is shown in FIG. 8(*c*), light is shut out for the first 75% of one frame period and light is projected only for the remaining 25%, by using the shutter array 300. When configured in this manner, it is possible to emit light as is shown in FIG. 8(*d*). By projecting light for only about 25% of one frame period in this manner, it is possible to suppress a sense of presence of an after image in moving pictures. This is because an image in the period during which no light is projected is interpolated by the human brain. The period of 25% was set giving consideration to the characteristics of an impulse-type display device, such as a CRT with excellent ability to playback moving pictures. Also, because light is shut out in the first portion of one frame period, the portion where brightness is unstable as is shown in FIG. 8(*b*) can be masked, which in turn makes it possible to display moving pictures in a stable manner.

FIG. 3 explains the adjustment of a quantity of light by the shutter array 300 setting 1/60 sec., which is a normal display period of one frame, to be one unit, the time-divisional control being effected during this unit. However, when playback processing of moving picture as described above is performed, projection is performed for 25% of the display period of one frame. The unit during which time-interval control is performed is therefore 25% of 1/60 sec.; that is, 1/240 sec.

Figure 9:
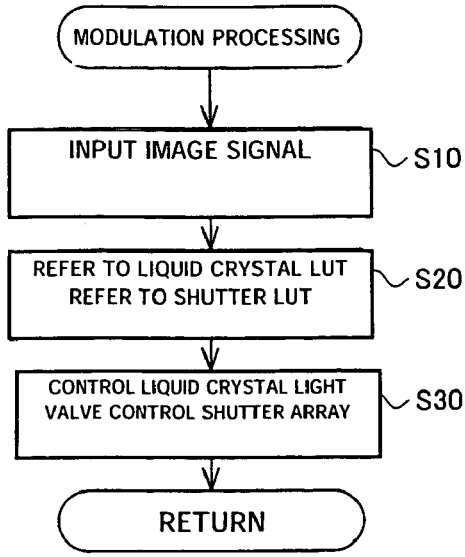
FIG. 9 is a flowchart detailing the modulation processing by a modulation control portion.

FIG. 9 is a flowchart detailing the modulation processing by the modulation control portion 600. Initially, upon input of an image signal (Step S11), the modulation control portion 600 refers to the liquid crystal LUT and the shutter LUT (Step S20). The modulation control portion 600 then modulates light by controlling the liquid crystal light valve 400 and the shutter array 300 according to these LUTs (Step S30). In this instance, the playback control of moving pictures as described above is performed concurrently. The projector 10 constantly performs the processing as described above while the power source stays ON.

While the invention has been described by way of example, the invention is not limited to the example above, and can adopt various configurations without deviating from the scope of the invention. For example, the playback processing of moving pictures shown in FIG. 8 may be configured to proceed only when moving pictures are projected, or may be performed when still images are projected as well. Alternatively, it may be configured not to proceed at all. In addition, operation may be configured so that the shutter array 300 is used only for the purpose of playback processing of moving pictures as described above, so that the liquid crystal light valve 400 alone performs light modulation. Besides the foregoing, the following modifications are possible.

Figure 10:
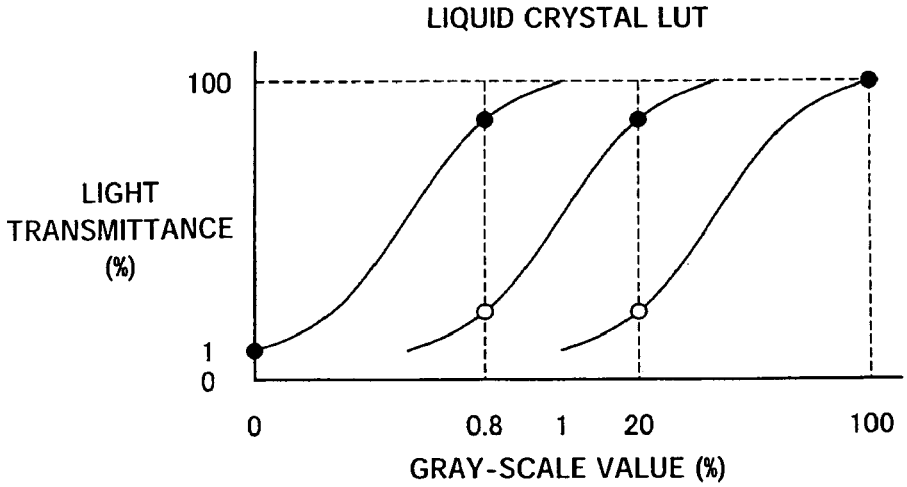
FIG. 10 is an explanatory view showing an example of modification of the liquid crystal LUT.
Figure 11:
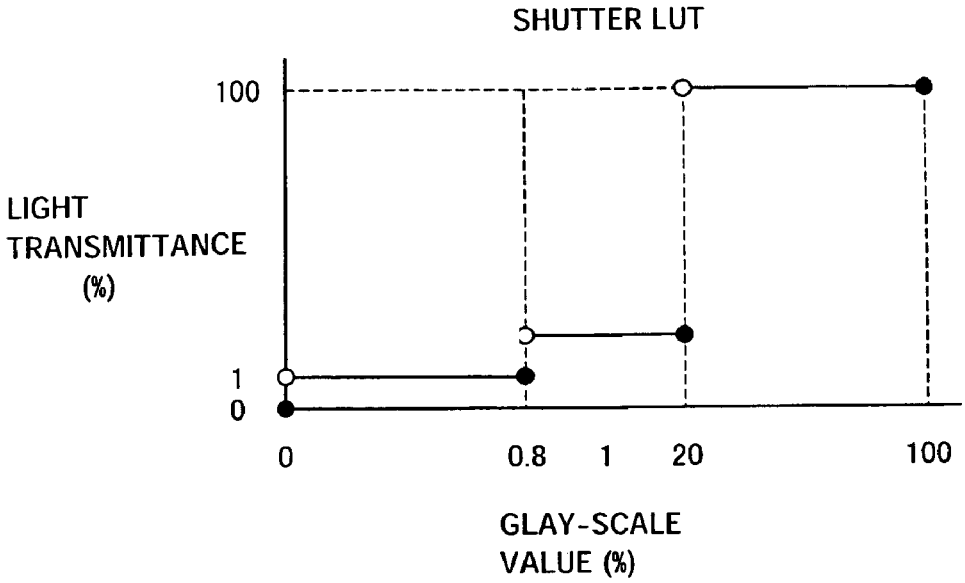
FIG. 11 is an explanatory view showing an example of modification of the shutter LUT.

FIG. 10 is an explanatory view showing the liquid crystal LUT as a modification. FIG. 11 is an explanatory view showing the shutter LUT as a modification. In the first example above, the control was switched at the gray-scale value of 1%. However, operation need not be limited to one the control switching point, as shown in FIG. 10 and FIG. 11, where the control is switched at more than one point. In this modification, the control is switched at two gray-scale values of 0.8% and 20%. By switching the control at more than one point in this manner, for example, it is possible to achieve modulation that exploits the linear characteristic of the liquid crystal light valve 400 in the vicinity of the half-tone.

Figure 12:
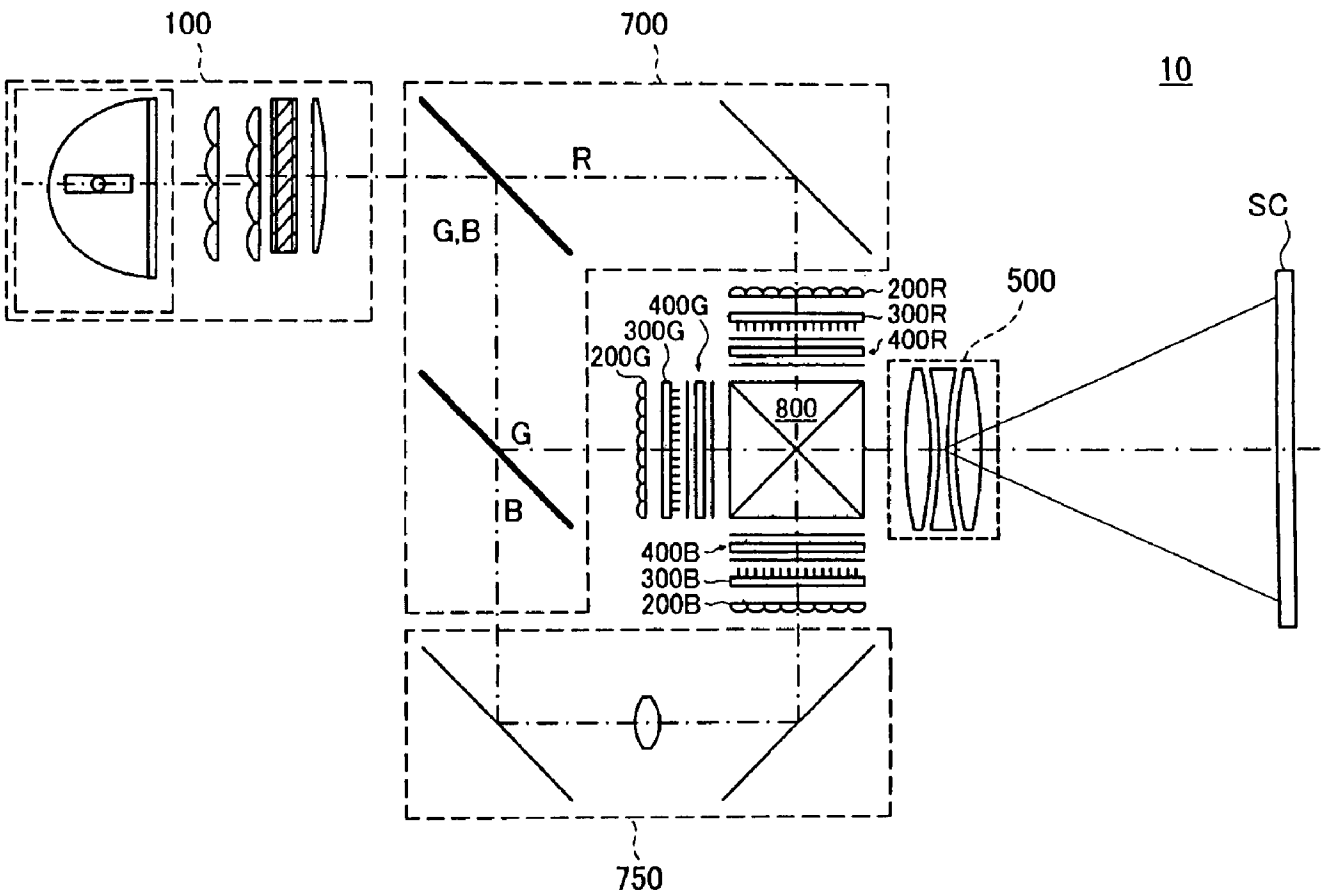
FIG. 12 is an explanatory view showing a modification of the projector.

FIG. 12 is an explanatory view showing a modification of the projector 10. In this modification, light emitted from the lighting optical system 100 is separated to beams of light of three primary colors including red, blue, and green by a color light separation optical system 700 and a relay optical system 750, and the beams of light are modulated color by color. Hence, the projector 10 of this modification includes three sets of micro-lens arrays (200R, 200G, or 200B), shutter arrays (300R, 300G, or 300B), and liquid crystal light valves (400R, 400G, or 400B). Beams of light modulated for respective RGB colors are synthesized in a crossed dichroic prism 800 to be scaled up and projected by the projection optical system 500.

As is shown in FIG. 1, in the example above, the micro-lens array 200 is provided between the lighting optical system 100 and the shutter array 300. However, besides this configuration, it may be provided, for example, between the shutter array 300 and the first polarizing plate 420. When configured in this manner, heat generation and deterioration in the first polarizing plate 420 and the second polarizing plate 430 can be suppressed. Alternatively, it may be provided between the first polarizing plate 420 and the liquid crystal panel 410, or between the liquid crystal panel 410 and the second polarizing plate 430. When configured in this manner, heat generation and deterioration in the second polarizing plate 430 can be suppressed.

In the example above, light is modulated by using both the liquid crystal light valve 400 and the shutter array 300. However, the shutter array 300 may be replaced by, for example, a DMD or ferroelectric liquid crystals to control transmission of light in a time-scheduled manner. Alternatively, a liquid crystal panel equivalent to the one used in the liquid crystal light valve 400 may be used. Even when configured in this manner, it is still possible to improve the contrast characteristic and the playback ability of moving pictures.

Accordingly, while this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A projector to project and display an image, comprising:

a light source;

a liquid crystal light valve;

a light quantity adjusting portion having elements in a one-to-one correspondence with respective pixels in the liquid crystal light valve, the light quantity adjusting portion being a shutter array, the elements adjusting a quantity of projected light by switching between two states for projecting and for not projecting according to time-divisional control, each element being able to individually switch to one of the two states while another element is in the other of the two states;

a modulation control portion that modulates light emitted from the light source by controlling the liquid crystal light valve and the light quantity adjusting portion in accordance with image signal representing the image;

the modulation control portion controlling the light quantity adjusting portion by referring to a shutter look up table, the shutter look up table defining a light transmittance of the shutter array according to gray-scale values of colors specified by the image signal, the shutter look up table having at least one gray-scale value at which the light transmittance changes discontinuously, the light transmittance having a first constant value for gray-scale values less than the at least one gray-scale value, the light transmittance having a second constant value for gray-scale values more than the at least one gray-scale value, and the second constant value being greater than the first constant value;

a projection portion that projects the modulated light.

2. The projector according to claim 1, the modulation control portion causing the light quantity adjusting portion to reduce the quantity of projection light to zero in a case where the color specified by the image signal is at a darkest level of gray-scale.

3. The projector according to claim 1, the modulation control portion causing the light quantity adjusting portion to increase the quantity of projection light to a maximum quantity when a color specified by the image signal is at a brighter level of gray-scale than a predetermined reference level, and modulating light by the liquid crystal light valve for the brighter level of gray-scale to be expressed.

4. The projector according to claim 1, the modulation control portion causing the light quantity adjusting portion to switch the quantity of projection light to be projected to a pre-set quantity of projection, in accordance with a level of gray-scale of a color specified by the image signal.

5. The projector according to claim 4, when a color specified by the image signal is at a relatively dark level of gray-scale, the modulation control portion causing the light quantity adjusting portion to switch the quantity of projection light to a predetermined quantity, and modulating light by adjusting the liquid crystal light valve for the darker levels of gray-scale to be expressed.

6. The projector according to claim 1, in order to control timings of the respective pixels in the liquid crystal light valve, the modulation control portion brings in sync the control timings of the respective elements in the light quantity adjusting portion that correspond to the respective pixels.

7. The projector according to claim 1, the liquid crystal light valve being provided with a liquid crystal panel, and a first polarizing plate and a second polarizing plate placed on a light incoming surface and a light outgoing surface, respectively, in a manner so as to sandwich the liquid crystal panel; and the light quantity adjusting portion being provided at least one location selected from a position between the light source and the first polarizing plate, between the first polarizing plate and the liquid crystal panel, and between the liquid crystal panel and the second polarizing plate.

8. The projector according to claim 1, the liquid crystal light valve being provided with a liquid crystal panel, and a first polarizing plate that serves as a light incoming surface and a second polarizing plate that serves as a light outgoing surface in a manner so as to sandwich the liquid crystal panel;

the light quantity adjusting portion being provided between the light source and the first polarizing plate; and a micro-lens array that condenses light respective elements in the light quantity adjusting portion being further provided between the light source and the light quantity adjusting portion.

9. The projector according to claim 1, the modulation control portion inhibiting the light quantity adjusting portion from projecting light for a predetermined period within a period over which one frame of an image is displayed.

10. The projector according to claim 9, the period during which projection of light is inhibited being a period from a start of projection to a predetermined elapsed time.

11. The projector according to claim 1, the modulation control portion controlling the liquid crystal light valve by referring to a liquid crystal look up table.

12. The projector according to claim 1, the shutter array being a set of shutter elements, and each shutter having a hinge used as an axis for opening and closing.

13. The projector according to claim 1, the modulation control portion adjusting the image signal pixel by pixel based on a look up table.

14. The projector according to claim 1, the modulation control portion being capable of sending a first control signal to a first element for the first element to be in one of the two states, and sending a second control signal that is different from the first signal to a second element for the second element to be in the other of the two states.

* * * * *